United States Patent [19]

Shields et al.

[11] 4,410,078

[45] Oct. 18, 1983

[54] ARTICLE DENSITY SENSING

[75] Inventors: Winston E. Shields, Justice; Robert F. Lantz, II, South Holland, both of Ill.

[73] Assignee: The Continental Group, Inc., New York, N.Y.

[21] Appl. No.: 42,694

[22] Filed: May 25, 1979

Related U.S. Application Data

[63] Continuation of Ser. No. 867,320, Jan. 5, 1978, abandoned, which is a continuation of Ser. No. 695,684, Jun. 14, 1976, abandoned.

[51] Int. Cl.[3] ..... B65G 47/46

[52] U.S. Cl. ..... 198/358; 198/444; 198/503

[58] Field of Search ..... 198/347, 358, 443–446, 198/464, 465, 467, 469, 502–505, 572, 573, 855, 856, 363, 367, 954, 356; 324/61 R, 61 P; 340/673, 674; 361/180

[56] References Cited

U.S. PATENT DOCUMENTS

| | | | |
|---|---|---|---|
| 2,642,173 | 6/1953 | Wehmiller et al. | 198/367 |
| 2,916,792 | 12/1959 | Crook et al. | 198/572 |
| 2,920,738 | 1/1960 | Carter | 198/443 |
| 2,966,253 | 12/1960 | Gerrans | 198/572 |
| 3,177,427 | 4/1965 | Kuntz et al. | 324/61 P |

*Primary Examiner*—Joseph E. Valenza
*Attorney, Agent, or Firm*—Charles E. Brown

[57] ABSTRACT

In a mass conveying system a variable branch of an electrical bridge network is sensitive to changes in the numerical density of articles within a predetermined portion of the system. The bridge network is responsive to an imbalance therein to generate a signal corresponding to the imbalance. Means responsive to the signal act to control delivery of articles to the system.

14 Claims, 6 Drawing Figures

ARTICLE DENSITY SENSING

This is a continuation of application Ser. No. 867,320 filed Jan. 5, 1978, now abandoned, as a continuation of Ser. No. 695,684 filed on June 14, 1976 now abandoned.

BACKGROUND OF THE INVENTION

This invention relates to a device for sensing the presence and numerical density of substantially identical articles in a space having predetermined boundaries, and also relates to a conveying system in which the number of articles in the system is regulated by control means which include such a device.

For the purpose of this specification the term "numerical density" is defined as the number of articles per unit volume of the space in question. In the case of a conveying system in which all the articles are directly supported on the same horizontal surface, it will be apparent that numerical density is equivalent to the number of articles per unit area of the surface.

It is a common practice in manufacturing to transport articles such as workpieces from one station to another in a so-called single-file conveying system. In such a system, articles discharged at a given rate from a first operating station are conducted in single file directly to a second operating station which is adapted to receive them at the same rate. In the case of high rates of production, single-file conveying systems must be operated at correspondingly high speeds. They are therefore noisy and may be subject to excessive wear.

Accordingly, mass conveying systems are now employed in many manufacturing operations. In a mass conveying system the articles are continuously agregated at the first station, that is, formed into a mass, and are transported in that mass to the second station or stations. While under normal conditions the rate at which articles are introduced to the conveying system is equal to the rate at which they are withdrawn from it, as in single-file arrangements, the system may be operated at a much lower speed for a given rate of production.

As in all conveying systems, however, a problem arises when input and output rates differ. For example, if the mass conveying system is employed to transport articles from a primary treating or work-performing mechanism to five secondary mechanisms arranged in parallel, it is obvious that the conveying system will remain in a stable condition if each of the secondary mechanisms is operated at one fifth of the rate of the primary mechanism. But if one of the secondary mechanisms should slow for one reason or another, or cease operation altogether, input to the conveying system will exceed output, and the number of articles in the system will rapidly increase.

Most mass conveying systems are provided with excess capacity so that they are able to accommodate momentary abnormal operating conditions. However, if the abnormal condition should persist until total capacity is exceeded, articles may be randomly ejected from the system, or jamming may occur, with consequent harm to the articles, the equipment, or both.

The conventional sensing devices employed to monitor single-file conveying systems are inadequate or wholly unsatisfactory when applied to mass conveying systems. Obviously, devices which make use of such sensors as photoelectric cells or microswitches to count individual articles passing a given point, or to calculate the rate of passage or travel, cannot perform the same functions with any accuracy at all when the articles are aggregated, unless elaborate and costly duplication or refinement is undertaken.

In some mass conveying systems a microswitch or photoelectric cell is located in a portion of the conveying system remote from the normal stream of article movement. When the presence of one or more articles is sensed, indicating that the conveying system has reached capacity or near-capacity, an alarm is energized, or the manufacturing operation is automatically halted.

In any event, efficient, uninterrupted operation of a mass conveying system has required the presence of an operator to monitor the condition of the system continuously and to take corrective action, as necessary, by exercising manual control. Depending on the length or complexity of the system, more than one operator may be required.

SUMMARY OF THE INVENTION

In accordance with the present invention, a sensing capacitor is provided in which the capacitor surfaces are disposed at opposite sides of a space to be monitored. At least one of the surfaces is electrically insulated from articles within the space so that the capacitance will vary in accordance with changes in the numerical density of articles within the space. Means are provided for comparing the variable capacitance with a reference capacitance, and for generating a signal which corresponds to the difference between the two capacitances. The space to be monitored may comprise a predetermined zone of a conveying system, and the signal may be employed, for example, to regulate operation at one or more stations delivering articles to the conveying system or receiving articles therefrom.

Also in accordance with the invention, a mass conveying system is provided in which a variable branch of an electrical bridge network is sensitive to changes in the numerical density of articles within a predetermined portion of the system. The bridge network is responsive to an imbalance therein to generate a signal corresponding to the imbalance. Means responsive to the signal act to control delivery of articles to the system.

Other features, advantages and objects of the invention will be apparent from the ensuing description taken in conjunction with the accompanying drawings.

THE DRAWINGS

THE PREFERRED EMBODIMENT

Figure 1:
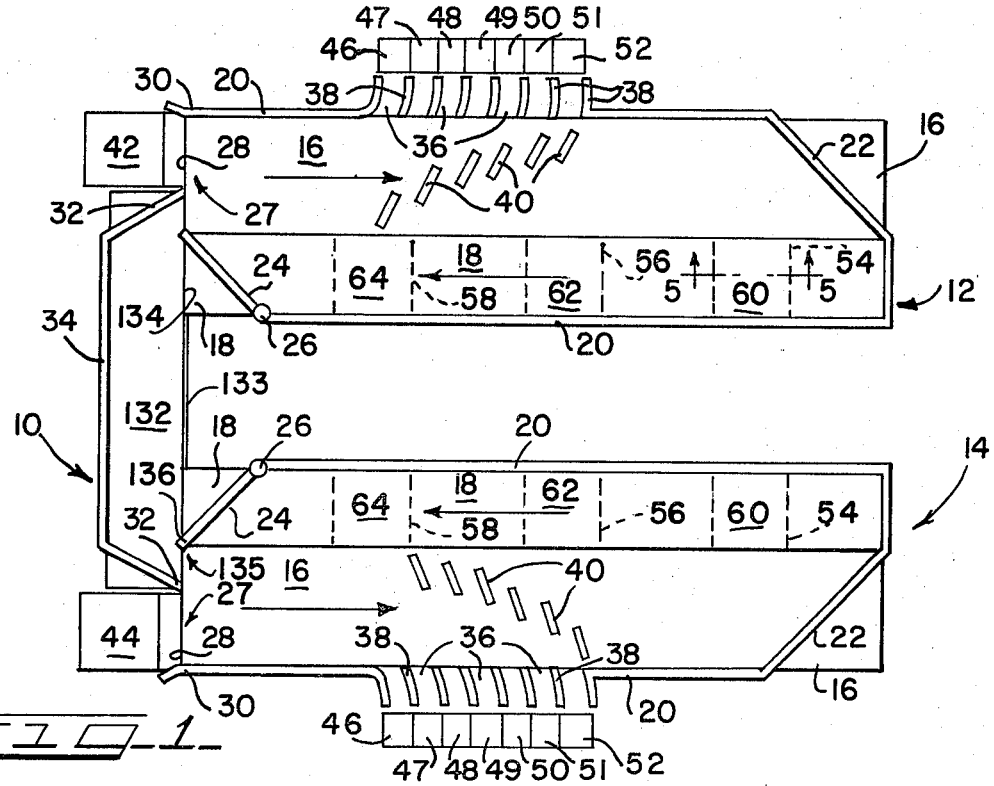
FIG. 1 is a schematic representation in plan view of a dual mass conveyor means comprising a pair of conveying systems in which the invention is incorporated.

The invention is hereinafter described with reference to mass conveyor means employed in the manufacture of so-called two-piece metal cans. The bodies of such cans, each consisting of a seamless cylindrical side wall closed at one end by an integral bottom wall, may be formed economically by a well-known method which need be described only briefly and which consists fundamentally of two steps, namely drawing and wall-ironing.

In the drawing step, a blank is cut from metal sheet, and a shallow cylindrical cup is instantaneously drawn from the blank. The cup is then wall-ironed, that is, it is elongated and its diameter and wall thickness are reduced, usually in a single operation, to produce a workpiece having dimensions which closely approximate those of the finished can body. The wall-ironed body is then subjected to any number of finishing steps. When finished, the can body is ready for filling and application of an end closure to provide a complete package.

Referring now to FIG. 1, a dual mass conveyor means 10 comprises a pair of conveying systems 12 and 14 which are identical reverse images of one another. While the two systems may be driven by a common dirve mechanism (not shown) at identical, constant speeds, each system is subject to extrinsic operating conditions which are unrelated to the other system.

Each conveying system 12, 14, comprises an endless supply conveyor 16 and an endless return conveyor 18 driven in opposite directions as indicated by arrows. Only the upper runs of the conveyors are visible in FIGS. 1 to 4 and are immediately adjacent to one another, as shown. Substantially surrounding conveyors 16 and 18 and spaced a small distance thereabove (FIG. 5) is a boundary rail 20 which includes a deflecting portion 22. The boundary rail encompasses a somewhat smaller area than the area occupied by the upper runs of the conveyors; it therefore defines the working surfaces of the conveyors and establishes the capacity of the conveying system. At one end of the boundary rail and extending obliquely across return conveyor 18 is a deflecting gate 24 which is mounted for limited rotation about a pivot 26 for a purpose to be explained hereinafter.

A receiving station 27 is established by an end 28 of the supply conveyor, an end 30 of boundary rail 20, and an end 32 of an auxiliary boundary rail 34, the purpose of which will be explained hereinafter. A series of seven discharge stations 36 is provided by openings in boundary rail 20, the discharge stations being separated by six guide rails 38.

A series of deflectors 40 is disposed above and spaced from main conveyor 16 and positioned to direct articles carried thereby toward discharge stations 36. Deflectors 40 are preferably mounted for pivotal movement about horizontal axes and biased toward the positions shown so that they may be pivoted upwardly if abnormally large forces are exerted on them by the articles and thereby permit passage of the articles beyond the deflectors, to the right as viewed in FIGS. 1 and 2.

Upstream of each receiving station 27 is a respective die press 42, 44, adapted to perform the drawing step previously described. Downstream of each discharge station 36 is a respective wall-ironing machine 46 to 52, the functions of which have also been described.

At three fixed locations along the length of return conveyor 18 are identical sensing devices 54, 56 and 58, shown in phantom outline in FIGS. 1 to 4. One of such devices is more particularly illustrated in FIG. 5 and described hereinbelow. The sensing devices preferably extend across the full width of return conveyor 18 and define respective sensing zones 60, 62 and 64 thereof.

Figure 2:
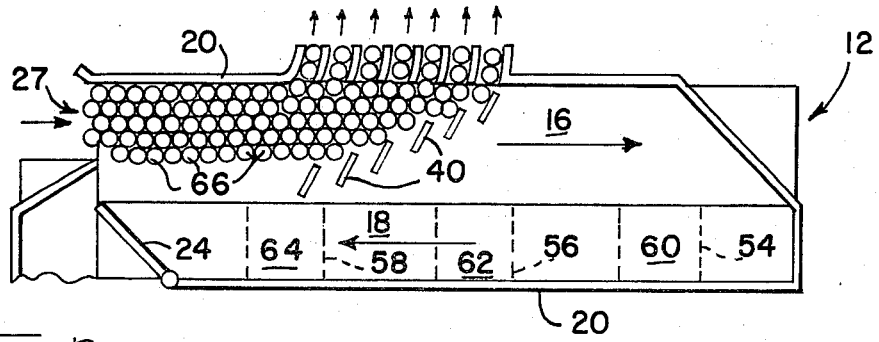
FIG. 2 is a view similar to FIG. 1 but represents one of the conveying systems in a normal condition of operation.

FIG. 2, in which only conveying system 12 is shown, represents the normal condition of operation. Articles in the form of drawn cups 66 are delivered to receiving station 27 from die press 42 (FIG. 1) where they are aggregated and transported in the direction to the right by supply conveyor 16. As outer ones of the cups encounter deflectors 40, the mass is directed toward discharge stations 36 (FIG. 1), whence the cups are conducted in single file to wall-ironing machines 46 to 52 as indicated by arrows. This may be done, for example, by means of chutes (not shown) of various lengths and configurations.

Assuming that each wall-ironing machine is operating at a rate at which it accepts, say, 130 cups per minute, the aggregate rate of the seven machines will be 910 cups per minute. Assuming also that die press 42 is provided with a gang of ten die sets, it must be operated at a rate of 91 strokes or drawing cycles per minute if input to the conveying system is to equal output and thereby maintain the normal operating condition represented in FIG. 2.

Figure 3:
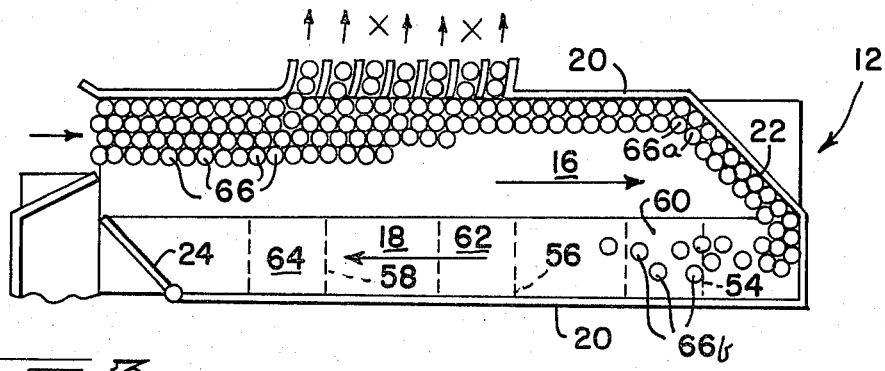
FIG. 3 is a view similar to FIG. 2 but represents the same conveying system in an abnormal condition of operation.

Now, referring to FIG. 3, from which deflectors 40 have been omitted for clarity, if wall-ironing machines 48 and 51 cease operation, as indicated by X-symbols in place of arrows, and die press 42 continues to operate at 91 cycles per minute, input to the conveying system will exceed output by some 260 cups per minute. Accordingly, a number of cups, **66*a*, will be forced past the deflectors and will eventually encounter deflecting portion 22 of boundary rail 20 to be turned toward return conveyor 18. In FIG. 3, which represents an early stage of such an abnormal condition, some of the cups, 66*b*, have been transferred from supply conveyor 16 to return conveyor 18 and are being transported in the return direction, that is, to the left. A few of them can be found in sensing zone 60** at the instant depicted.

Figure 4:
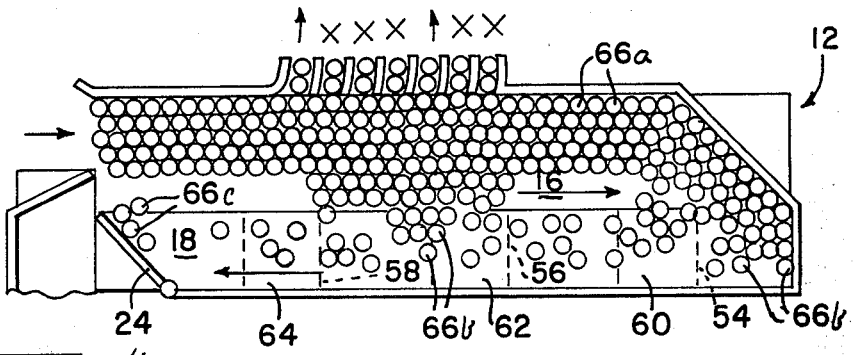
FIG. 4 is a view similar to FIGS. 2 and 3 but represents the same conveying system in an extreme condition of operation.

FIG. 4 represents an extreme condition in which five wall-ironing machines 47, 48, 49, 51 and 52 have ceased operation. Supply conveyor 16 has reached near-capacity and cups **66*b* are being transferred therefrom to return conveyor 18 at several points. The transferred cups are present in various numbers in sensing zones 60, 62 and 64 at the instant depicted. A few, 66*c*, have encountered deflecting gate 24 and are being returned to supply conveyor 16, where they can only aggravate an already precarious condition. In fact, without prompt corrective action, the whole of conveying system 12 will soon reach capacity. The control means of FIG. 6, which incorporates sensing devices 54, 56 and 58**, is intended to provide such corrective action before extreme condition can occur.

Figure 5:
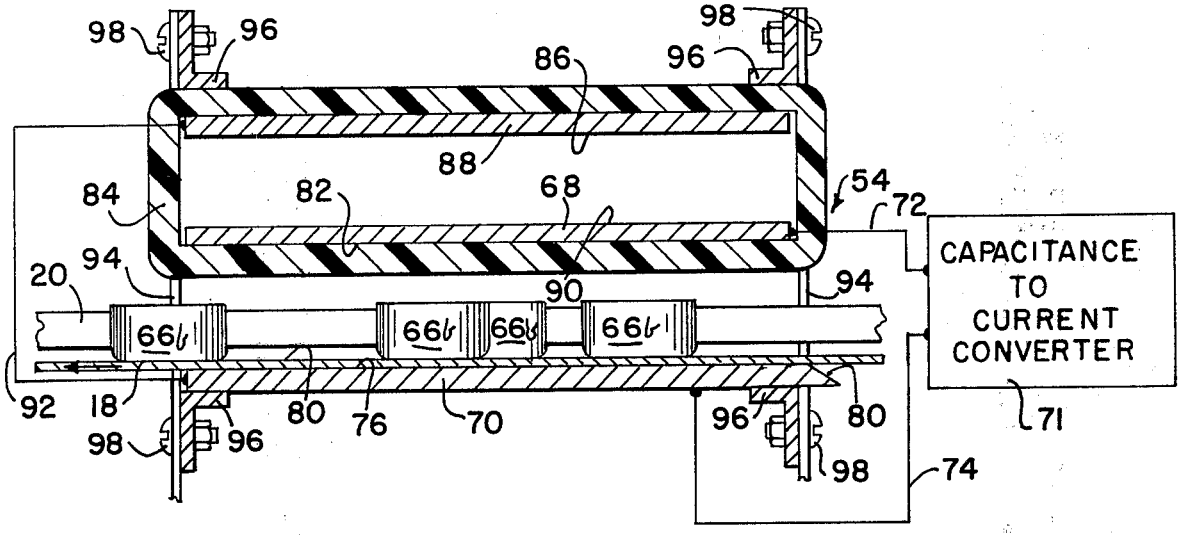
FIG. 5 is an enlarged, schematic sectional view in elevation of a sensing device in accordance with the invention, taken along line 5—5 of FIG. 1, and also depicts a portion of a conveyor with articles supported thereon.

Referring first to FIG. 5, sensing device 54 comprises a capacitor which includes an upper capacitor electrode 68 and a lower capacitor electrode 70 and which is connected for conduction with a source 71 of electric potential. More particularly, the upper and lower electrodes are connected with source 71 by means of conductors 72 and 74, respectively. Source 71 is a capacitance-to-current converter, as will be explained with greater particularity below.

An upper surface 76 of lower electrode 70 is in sliding electrical contact with a lower surface 78 of the upper run of return conveyor 18, a beveled portion 80 of the lower electrode facilitating relative movement between the two. While return conveyor 18 is represented as a solid belt for simplicity, it is preferably an articulated mat formed of an electrically conductive material such as stainless steel and so constructed as to provide a flat upper surface 80 for support of cups 66*b*. Such mats are commonly found in the conveyor art and require no further description.

With the construction described, it will be apparent that when an electric potential is applied to sensing capacitor 54, a portion of conveyor surface 80 coextensive with electrode surface 76 will become a first capacitor surface. For reasons of safety and expedience, conveying system 12 and thus return conveyor 18 are connected to ground.

A second capacitor surface 82 is provided by a lower surface of electrode 68 and is disposed in spaced confronting relation with the first capacitor surface provided on return conveyor 18. The confronting capacitor surfaces are substantially identical in area and define sensing zone 60. Electrode 68 is spaced from conveyor surface 80 a distance sufficient to permit cups 66*b* to clear capacitor surface 82 as they pass therebeneath. To preclude any possibility that sensing capacitor 54 will be inadvertently shorted, electrode 68 is completely enclosed in an electrically nonconductive housing 84.

As is commonly recognized, capacitance is inversely proportional to the distance between the confronting capacitor surfaces. Thus, with the construction shown, the capacitance of sensing capacitor 54 will remain constant so long as no cups 66*b* are present in the space between and defined by the capacitor surfaces. However, because the cups are formed of conductive material, when one or more cups or portions thereof enter the space, that is, when they enter sensing zone 60, they effectively become a part of the lower capacitor surface on which they are supported and act to diminish the average distance between the capacitor surfaces. The capacitance of sensing capacitor 54 therefore varies in accordance with changes in the numerical density of cups within the sensing zone.

It is pointed out, on the other hand, that the invention is not limited to use with conductive articles. Noting that capacitance is directly proportional to the dielectric constant of the nonconductive material between the capacitor surfaces (established in this instance by the combined dielectric characteristics of the ambient air and the material of housing 84), the dielectric constant will be altered in accordance with the presence and number of nonconductive articles within the sensing zone. Such articles might be formed of glass or certain plastics, for example. However, all other conditions being equal, the resulting variations in capacitance will be smaller than those resulting from conductive articles of substantial height relative to the distance between the capacitor surfaces.

In any event, sensitivity is enhanced if the area of each of the capacitor surfaces is large relative to the surface area covered by each of the articles. In the case of a metallic cup having a diameter of approximately three inches, a capacitive area eighteen inches square has been found to be satisfactory.

To protect the sensing capacitor from stray capacitance, a shielding capacitor is provided by the lower surface 86 of a third capacitor electrode 88 in cooperation with an upper surface 90 of electrode 68. Capacitor 88 is also enclosed within housing 84 and is spaced a fixed distance above electrode 68. For convenience, electrode 88 may be electrically connected to lower electrode 70 by means of a conductor 92.

Electrodes 68 and 88 are fixed in position within housing 84 by any suitable means such as adhesives. Housing 84 and lower electrode 70 may be mounted on frame members 94 of conveying system 12 by any suitable means such as angle irons 96 and fastening means 98. The fastening means are preferably adjustable to some degree; for example they may be received in elongated openings (not shown) formed in frame members 94 to permit adjustment of the parallelism and distance between electrodes 68 and 70.

While electrodes 68, 70 and 88 are represented as solid plates in the drawings, the latter two may be formed of a metallic mesh and housing 84 may be formed of a transparent material, so that conditions within the sensing zone may be observed visually from above.

Figure 6:
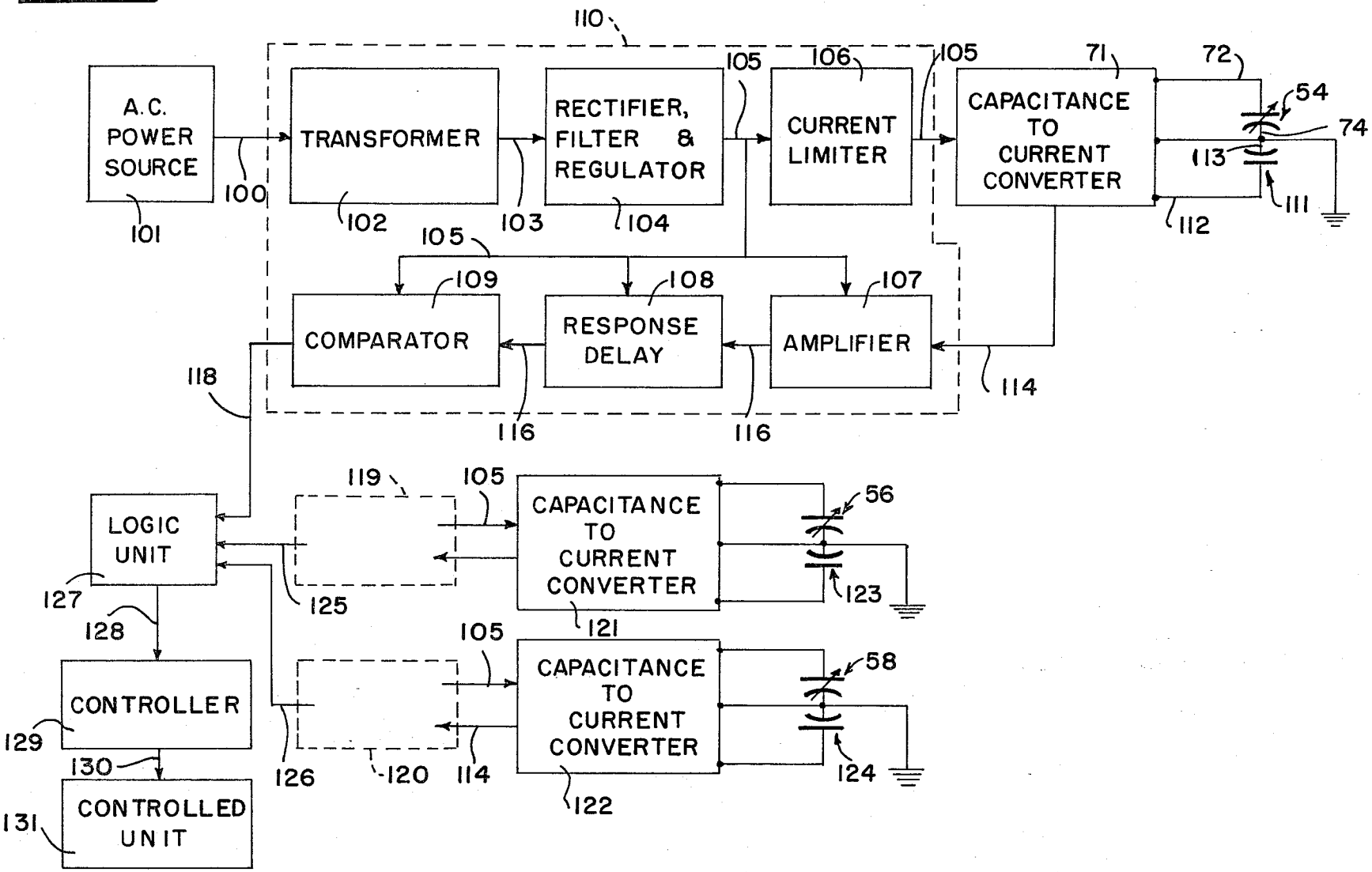
FIG. 6 is a diagrammatic representation of control means arranged in accordance with the invention.

The control means in which sensing capacitors 54, 56 and 58 are incorporated is shown diagrammatically in FIG. 6 and comprises an arrangement of well-known electrical devices. Power 100 is supplied by an alternating-current power source 101 to a transformer 102 which, in turn, supplies power 103 at reduced potential to rectifier, filter and regulator circuits 104. The latter provide a constant, filtered direct-current potential 105 to a current limiter 106, an amplifier 107, a response delay 108, and a comparator 109.

The six devices 102, 104, 106, 107, 108 and 109 may be conveniently contained as a control unit 110 within a single housing, whereby they may be isolated from the atmosphere, from working spaces and equipment, and from hazardous materials. The current limiter is provided for safety reasons to limit the energy released from control unit 110 to other elements of the system.

Direct-current potential 105 is applied by the current limiter to the previously mentioned capacitance-to-current converter 71, which comprises an electrical bridge network including an oscillator (not shown) for the generation of a relatively high-frequency alternating-current potential. Such electrical bridge networks are well known in the measurement or detection of capacitance. Appropriate examples are illustrated and described with particularity in U.S. Pat. Nos. 3,271,669 and 3,318,153, issued Sept. 6, 1966 and May 9, 1967, respectively, to T. Lode and assigned to Rosemount Engineering Company, Minneapolis, from which suitable capacitance-to-current converters are commercially available. Forming one arm of the bridge network is sensing capacitor 54 and the associated conductors 72 and 74. Another arm of the bridge network is provided by a reference capacitor 111 and associated conductors 112 and 113. These two arms of the bridge network have a common junction 75 which is grounded as indicated in FIG. 6.

Reference capacitor 111 may be of construction similar to capacitor 54 but is electrically isolated from conveying system 12 and random capacitive influences. However, it is preferably exposed to the conditions of temperature and humidity to which sensing capacitor 54 is subject so that variations in capacitance due to changes in those conditions will be reflected equally in both capacitors. Reference capacitor 111 is also preferably constructed in a manner such that its capacitance, the reference capacitance, may readily be adjusted manually.

While the reference capacitance will usually be established to correspond to the capacitance of the sensing capacitor when no articles are in the sensing zone, in some systems a predetermined number of articles within the zone might be considered a normal condition and the reference capacitance fixed accordingly.

Any imbalance in the arms of the bridge network, that is, a difference in capacitance between capacitors 54 and 111, will cause a signal 114 to be generated by converter 71. Signal 114 is an electric current whose sign will vary in dependence upon whether the variable capacitance is greater or less than the reference capacitance. Its magnitude will be proportional to the amount of the difference between the two capacitances.

Signal 114 is directed to amplifier 107, and an amplified signal 116 is delivered therefrom to response delay 108. The latter is preferably adjustable and is provided to prevent the control means from reacting needlessly to momentary aberrations from normal operation. If signal 116 persists for a time greater than the predetermined period to which the response delay has been adjusted, signal 116 will be transmitted to a comparator 109.

Comparator 109 may be a simple circuit able to detect only those signals above a predetermined magnitude, or preferably it may consist of several comparator circuits which establish therebetween various graduated levels corresponding to predetermined ranges of conditions within the sensing zone. Accordingly, in response to amplified signal 116 comparator 109 generates a signal 118 indicative merely of the existence of an abnormal condition within the sensing zone, or preferably one which is indicative of the existence of a particular range of abnormal conditions.

Respective control units 119 and 120, identical with control unit 110, and respective capacitance-to-current converters 121 and 122, identical with converter 71, are provided in association with sensing capacitors 56 and 58. Each of the latter two sensing capacitors is paired with a respective reference capacitor 123, 124, so that each reference capacitor or the corresponding bridge network may be individually tuned before commencement of operation to accurately reflect the normal condition of operation in the sensing zone with which it is associated.

Control units 119 and 120, functioning in the manner described in connection with control unit 110, generate signals 125 and 126, respectively, which are indicative of operating conditions within sensing zones 62 and 64.

Signals 118, 125 and 126 are directed to a logic unit 127, which may be a dedicated computer for example, programmed in accordance with all possible combinations of signals to be received to deduce therefrom the overall operating condition existing within the respective conveying system 12, 14. (No signal, that is, a lack of output from one of the control units 110, 119 or 120, is indicative of a normal operating condition within the respective zone monitored, and will of course be treated as an informative "signal" by the logic unit.)

If the logic unit determines in accordance with its program that corrective action is called for, it will transmit an appropriate control signal 128 to a controller 129, which may be an electrical switching relay device. The controller, in turn, will transmit an appropriate command signal 130 to the controlled unit 131, which may be a drive motor unit for die press 42, for example, or a power transmission unit therefor. Depending upon the overall condition prevailing within the conveying system, as sensed by capacitors 54, 56 and 58, command signal 130 may comprise a command to stop, to start, to decrease speed, or to increase speed.

Returning now to FIG. 1, an auxiliary conveyor system is provided to avoid starving any of wall-ironing machines 46 to 52 in the event either of die presses 42 and 44 should cease operation. The auxiliary system comprises essentially deflecting gates 24, auxiliary boundary rail 34, and an endless auxiliary conveyor 132 which is normally at rest but which may be driven in either direction.

If, for example, die press 42 should cease operation, the wall-ironing machines supplied by conveyor system 12 would soon be starved without corrective action. Such action may be initiated by rotating the deflecting gate 24 associated with conveyor system 14 in the clockwise direction to a horizontal position as viewed in FIG. 1, and by driving auxiliary conveyor 132 in the upward direction, also as viewed in FIG. 1. Other controls, including the control means of FIG. 6, can then be overridden to increase the output of die press 44.

The excess articles will be delivered to auxiliary conveyor 132 by return conveyor 18 of conveyor system 14. From auxiliary conveyor 132 they will be delivered to supply conveyor 16 of conveyor system 12.

It will be readily apparent that automatic control of the auxiliary conveyor system can be exercised by employing auxiliary control means similar to that represented in FIG. 6 but appropriately modified to provide the necessary command and override signals. For example, the auxiliary control means might incorporate sensing capacitors located at receiving stations 27 and so related to associated reference capacitors as to detect the absence of articles at either of the receiving stations.

While the invention has been described in connection with a specific embodiment thereof, it will be understood that this is by way of illustration and not of limitation, and that the scope of the appended claims should be construed as broadly as the prior art will permit.

What is claimed is:

1. In a conveying system for transportation of substantially identical articles from a first operating station to a second operating station, the conveying system including a moving supply conveyor for moving articles from said first operating station to said second operating station and beyond, and a moving return conveyor for receiving articles passing beyond said second operating station, said moving return conveyor being of a width in excess of the width of an intended article and wherein a plurality of the articles may be disposed on said return conveyor generally in random rows and colums; control means for regulating the number of articles present in the conveying system, said control means including at least one sensing zone extending along a predetermined linear portion of said return conveyor; sensing means operatively associated with said sensing zone for sensing the density of randomly arranged articles disposed on said return conveyor in said sensing zone, signal means for generating a signal in accordance with the sensed density, and regulating means for receiving the signal and regulating operation at one of said operating stations in accordance therewith.

2. The conveying system of claim 1 wherein said return conveyor is a reversely running conveyor relative to said supply conveyor.

3. The conveying system of claim 2 together with gate means overlying said reversely running conveyor downstream of said control zone, and said gate means being selectively positionable to selectively recycle articles within said conveying system and discharging articles from said conveying system.

4. The conveying system of claim 1 wherein said second operating station includes a plurality of machines independently operable and having a combined capacity generally equal to the capacity of said first operating station.

5. The conveying system of claim 4 wherein said first operating station includes at least one variable capacity machine, and said regulating means includes means for varying the capacity of said variable capacity machine.

6. In a conveying system, a first variable supply means, a first article receiving means, a first supply conveyor extending from said first supply means to said first receiving means and beyond, a first return conveyor for receiving excess articles from said first supply conveyor, a second article supply means, a second article receiving means, a second supply conveyor extending from said second supply means to said second receiving means, an auxiliary conveyor extending from said first return conveyor to said second supply conveyor between said second supply means and said second receiving means, a diverter gate associated with said first return conveyor for selectively diverting excess articles from said first return conveyor onto said first supply conveyor for recycling and onto said auxiliary conveyor for diversion to said second article receiving means, article detecting means at at least one control zone positioned along said first return conveyor for detecting the presence of one or more excess articles on said first return conveyor, said article detecting means providing signal means to indicate the required position of said diverter gate.

7. The conveying system of claim 6 wherein there is a second return conveyor for receiving excess articles from said second supply conveyor, and said auxiliary conveyor also extends between said second return conveyor and said first supply conveyor.

8. The conveyor system of claim 1 wherein said control means includes a sensing capacitor having first and second capacitor surfaces disposed in spaced confronting relation at opposite sides of the conveying means, the projected area of one of the confronting surfaces defining said sensing zone, said sensing capacitor being connected for conduction with a source of electric potential, at least said first capacitor surface being electrically insulated from articles within said sensing zone whereby the capacitance of said sensing capacitor is variable in accordance with changes in the numerical sensity of articles within said sensing zone, means for establishing a fixed reference capacitance corresponding to a predetermined condition of numerical density, said signal means including means for comparing said variable and reference capacitances and generating a singal corresponding to the difference therebetween.

9. The conveying system of claim 8 wherein said conveyor means includes an electrically conductive horizontal conveying surface for supporting articles of substantially uniform predetermined height thereon, the sensing capacitor comprising first and second capacitor electrodes, the first electrode being disposed above the conveying surface and spaced therefrom a distance greater than the article height to electrically insulate the first electrode from articles supported on the conveying surface, a lower surface of the first electrode comprising the first capacitor surface, the second electrode being disposed below the conveying surface and connected for conduction therewith, whereby that portion of the conveying surface within the sensing zone comprises the second capacitor.

10. The conveying system of claim 9 wherein the conveying surface comprises an upper surface of the conveyor, the further improvement comprising the feature that the second electrode is in sliding engagement with a lower surface of the conveyor opposed to the upper surface thereof.

11. The conveying system of claim 8 wherein said means for establishing a reference capacitance comprises a reference capacitor electrically isolated from said conveyor means and connected for conduction with said source of electric potential, and the comparing and signal-generating means comprises an electrical bridge network providing said source of potential, the variable capacitor being connected in one branch of the bridge network, the reference capacitor being connected in another branch of the bridge network, said one branch and said other branch having a common junction, the reference capacitor being exposed to the atmospheric conditions to which the variable capacitor is exposed whereby changes in the atmospheric conditions affect the variable and reference capacitors substantially equally.

12. The conveying system of claim 8 wherein said reference capacitance is manually adjustable to select said predetermined condition.

13. In a conveying system as defined in claim 11, the further improvement comprising the features that the control means includes a third capacitor electrode disposed above the first electrode in spaced confronting relation therewith, the third electrode being connected for conduction with said source of electric potential, whereby the first and third electrodes cooperate to provide a shielding capacitor of substantially constant capacitance isolating the first capacitor surface from stray capacitances.

14. In a conveying system as defined in claim 13, the further improvement comprising the feature that the third electrode is connected for conduction with the second electrode.

* * * * *